United States Patent [19]

Karlén

[11] Patent Number: 4,605,093

[45] Date of Patent: Aug. 12, 1986

[54] DEVICE FOR ABSORPTION OF SOUND WAVES

[75] Inventor: Lennart Karlén, Stockholm, Sweden

[73] Assignee: Gullfiber Akustik AB, Billesholm, Sweden

[21] Appl. No.: 755,378

[22] PCT Filed: Oct. 30, 1984

[86] PCT No.: PCT/SE84/00365

§ 371 Date: Jun. 27, 1985

§ 102(e) Date: Jun. 27, 1985

[87] PCT Pub. No.: WO85/01975

PCT Pub. Date: May 9, 1985

[30] Foreign Application Priority Data

Oct. 31, 1983 [SE] Sweden ..... 8305972

[51] Int. Cl.[4] ..... E04B 1/82

[52] U.S. Cl. ..... 181/295; 181/30; 181/286; 181/288; 181/290; 181/294

[58] Field of Search ....., 181/30, 284, 295, 286, 181/288, 290, 294

[56] References Cited

U.S. PATENT DOCUMENTS 2,980,198 4/1961 Eckel ..... 181/295

3,404,498 10/1968 Espinoza ..... 181/295 X

*Primary Examiner*—Benjamin R. Fuller

*Attorney, Agent, or Firm*—Cushman, Darby & Cushman

[57] ABSTRACT

A device having a high sound absorption ability and intended for use as floor, wall and/or ceiling facing in so-called echo-free rooms (10), i.e. in acoustic measuring rooms designed according to international standard, ISO-3745, in picture and sound recording studios, in sound laboratories etc., in which a sound propagation as in a free field is desired. The new device is based on sound absorbents in the form of plates (16, 20) forming a substrate support (16) and units (20) projecting obliquely from this which are so placed that they have a wave-like cross-section. The size and reciprocal angular conditions of the sound absorbents (20) projecting from the substrate support (16) are chosen so that at least double reflection is always obtained before a sound wave deriving from a measuring object (12) is directed from the device. The sound absorption ability is further increased by utilizing a low-frequency cavity resonance between the projecting sound absorbents (20) and the substrate support (16).

5 Claims, 6 Drawing Figures

A)

B)

DEVICE FOR ABSORPTION OF SOUND WAVES

This invention relates to a device for absorbing sound waves and intended for use as an internal facing, primarily in so-called echo-free rooms, in which recording and measurement of sound are carried out by means of sensitive measuring instruments.

Devices of said type are suited for use in all rooms where a high degree of reflection freedom is desired, e.g. in measuring rooms made in accordance with international standard, ISO 3745, in sound and picture recording studios, in sound laboratories etc. In all these rooms a sound field is desired which corresponds to free sound wave propagation, the strenght of the sound reflex in the limiting surfaces being very small. According to the ISO-standard a sound absorption ability of 99.9% is required within the current frequency range, but in certain cases a sound absorption ability of 99.0% in a medium high sound frequency range from e.g. 200 Hz is sufficient.

A device of the intended type should be well suited as facing both on walls, in ceilings and on floors.

Previously known constructions for absorption of sound waves in echo-free rooms comprise primarily facings in the form of wedges of blocks and wads or cubes of sound absorbing material suspended in threads in immediate connection with walls, ceilings and floors. The purpose of the used constructions is to achieve impedance adaption of the propagation medium, i.e. air, in the intended room in order to obliterate in this way the limit of the propagation of the sound waves.

The known constructions have many shortcomings. Thus, they require separate, specially designed building elements the manufacture of which is expensive. These building elements are often difficult to assemble, especially in connection with floors and ceilings and therefore involve a time-consuming work. Moreover, it is difficult and in certain cases impossible to clean them. It is also difficult to replace damaged building elements of this type. As the building elements comprise unprotected mineral fiber material there is also a great risk of fibers coming loose, the environment of the room being deteriorated.

It is now the object of the invention to provide a sound absorption device eliminating all the disadvantages in connection with known constructions, particular stress being laid on utilizing simple building elements easy to mount and giving a very high sound absorption. This is achieved in that the absorption device of the invention comprises a substrate support which e.g. consists of mineral wool sheets or plate to which plate-shaped sound absorbents, preferably of mineral wool are inclined relative to each other in such a way that they will have a wave-shaped cross-section. The angle between two sound absorbents placed on the substrate support with their edges close to each other should be easily adjustable and is chosen in such a way that the sound waves deriving from a sound source are always reflected at least twice against the sound absorbents before they leave the device. In order to obtain further improvement of the sound absorption ability at the lower portion of the intended frequency range the substrate support together with two adjacent sound absorbents placed on the substrate support should, moreover, define a cavity with a gap-shaped opening disposed between the sound absorbents and/or between sound absorbent and substrate support, which opening is so adapted that cavity resonance is obtained at a predetermined lower frequency range.

A sound absorption device built in the abovementioned manner can utilize usual rectangular plane mineral wool plates of a standard format as sound absorbents. The width of the plates is chosen in dependence of desired lower limit frequency of the operating range of the sound absorbents.

The invention will now be described more in detail below in the form of a preferred illustrative example with reference to the accompanying drawing.

FIG. 1 is a top plan view of a section of an echo-free room comprising the sound absorption device of the invention.

FIGS. 2A and 2B disclose on an enlarged scale a part of the sound absorption device illustrated in FIG. 1.

Figure 1:
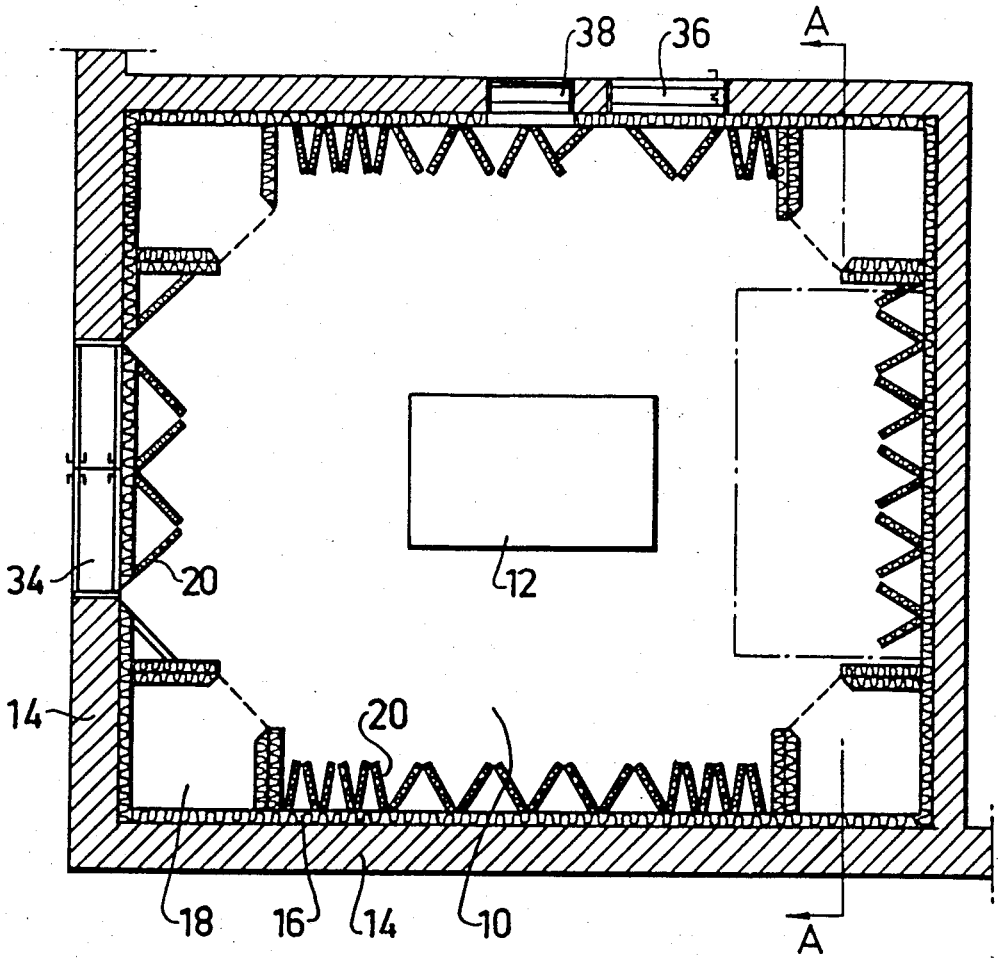
Figure 4:
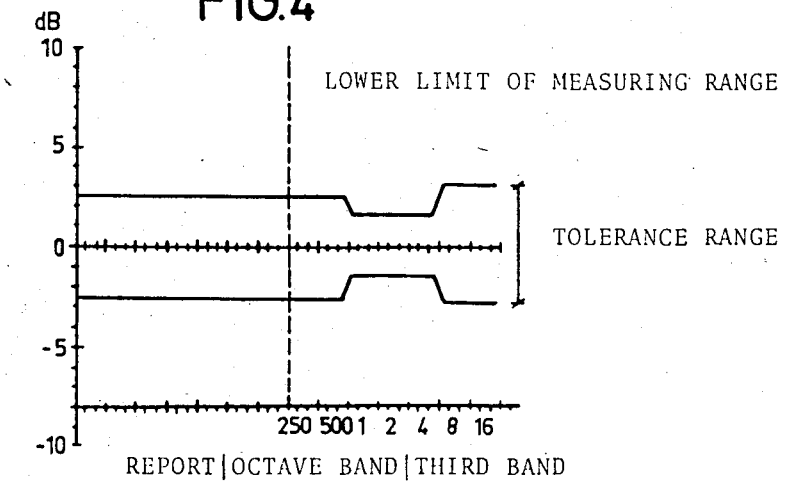
FIG. 4 shows the embodiment of a result diagram used to obtain the result evaluated by the aid of a computer of measurements made according to the measuring diagrams in tables 1–4.

The echo-free room 10 illustrated in FIG. 1 is especially intended for measurements of noise of car engines, the position of the measuring object 12 for obtaining the best measuring result being limited to the central part of the room 10. On the drawing sound absorbing devices are disclosed only in connection with the walls 14 of the room 10 but similar devices should of course also be arranged in the ceiling of the room 10 and optionally also in connection with its bottom portion. In the latter case the real supporting floor surface consists of a lattice-work placed above the sound absorbents projecting from the bottom portion.

As is apparent from the drawing, especially FIG. 1, the room 10 is internally covered with a substrate support 16 of sound absorbent material. This consists preferably of mineral wool plates fixed to the relative wall 14 in a way known per se, e.g. by means of round metal wires (not shown) passing through. In the four corners of the room 10 there are special air drums 18 through which fresh air is fed into the room. There are also similar arrangements not shown close to the ceiling to divert off-air. All the air drums are covered by substrate supports 16 of sound-absorbing material of the same type as that used for the walls 14.

Figure 2:
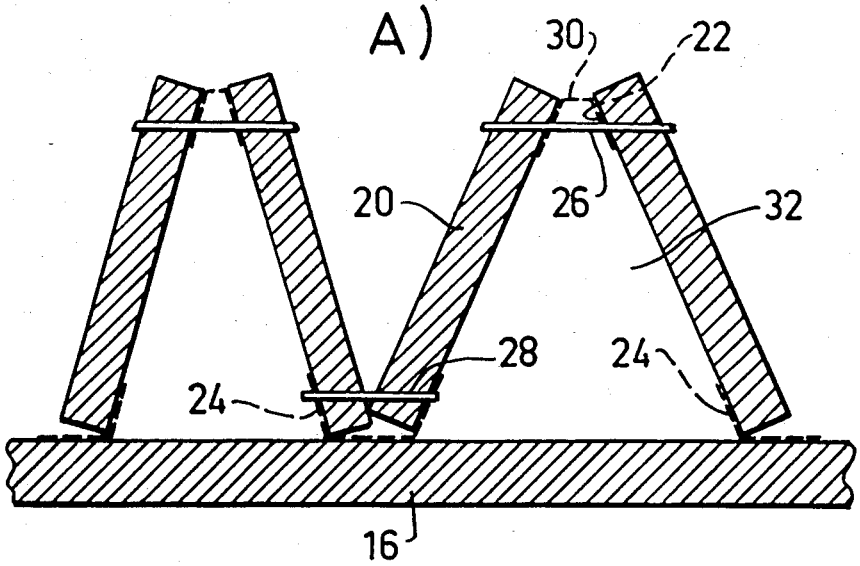
Figure 2:
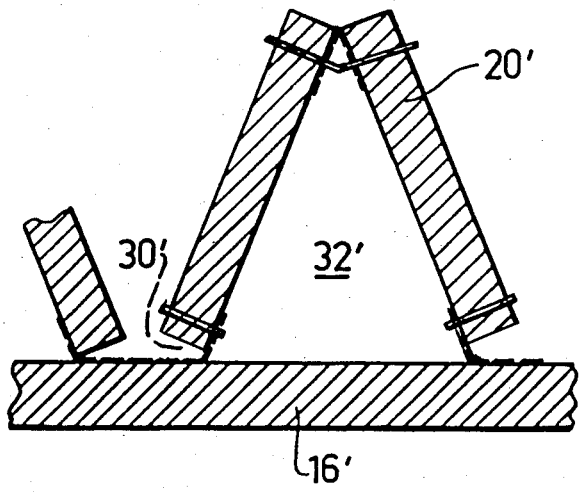
Figure 3A:
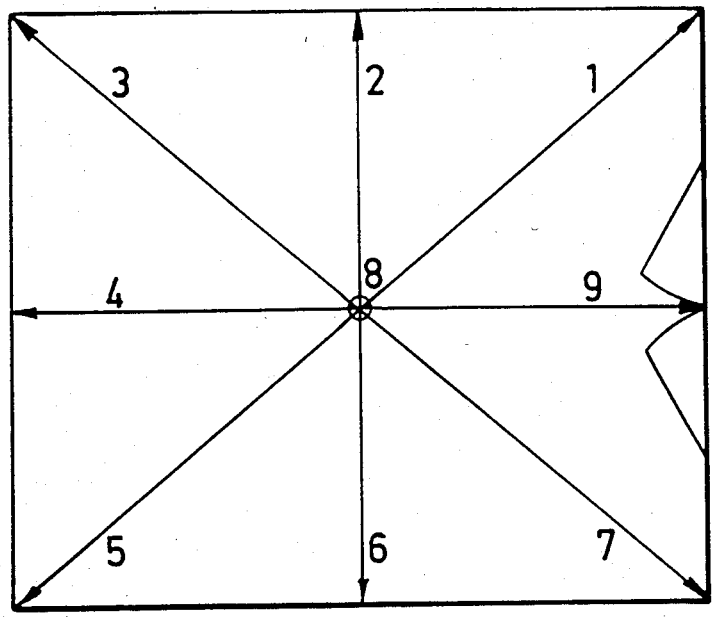
FIGS. 3A and 3B show diagrams of measuring lines of a measuring object centrally located in a room at test measurements according to International Standard ISO 3745.
Figure 3B:
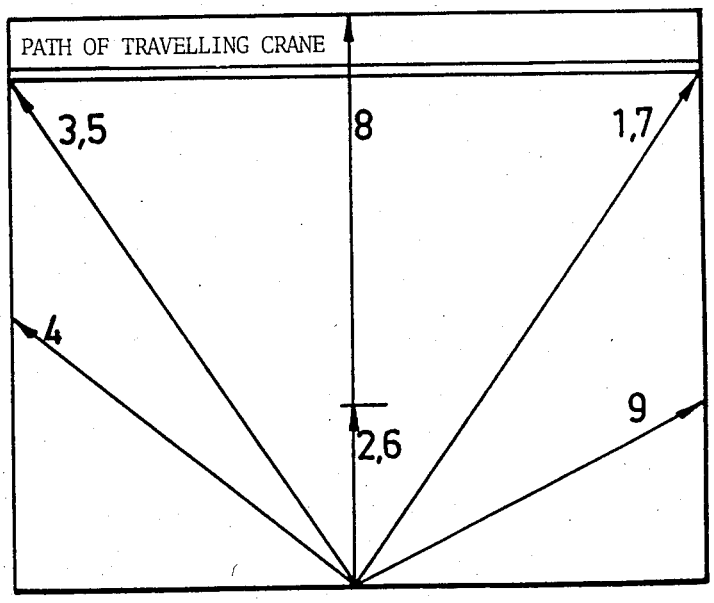

Plate-shaped sound absorbents 20 project from the walls 14. These are placed on edge two by two close to each other on the substrate support 16 so that a predetermined angle is formed between them. The sound absorbents 20 extend from floor to ceiling, which means in reality that several sound absorbents 20 are placed above each other edge to edge. In the arrangement shown the sound absorbents 20 are vertically oriented but this is no demand. The sound absorbents 20 in each pair have at the attachment to the substrate support 16 their adjacent edges placed close to each other. The oppositely located edges of the sound absorbents of adjacent sound absorbent pairs have a reciprocal interspace as is especially apparent from FIG. 2A.

The angles between the sound absorbents 20 in each pair of sound absorbents are so chosen that sound waves deriving from the measuring object 12 are always reflected at least twice against the sound absorbents 20 before they are again directed to the room 10. In this way a sound absorption of at least 99% is obtained as the sound absorption ability of the sound absorbents 20 chosen in the present case, i.e. the mineral wool plates, which are of standard type, amounts of between 90 and 95%. For the mutual fixation of the sound absorbents 20 and for their mounting onto the substrate support 16 perforated plate stripes of ductile stretch metal bands 22, 24 (see FIG. 2A) known per see are utilized which run along and overlap the edges of the sound absorbents 20 facing each other and do not block the way of the sound waves appreciably. Besides said stretch metal bands 22, 24 round zinc threads 26, 28 are also used for the reciprocal fixation of the sound absorbents 20, which threads run through the bands 22, 24 and the sound absorbents 20, as is especially evident from FIG. 2. These fixing threads 26, 28 are of the same type as the threads anchoring the sound absorbents 20 to the substrate support 16.

At the edges of the sound absorbents 20 facing away from the substrate support 16 an adjustable desired width of the gap 30 is ensured by a corresponding bending of the relative stretch metal band 22. Two adjacent sound absorbents 20 which are placed against the substrate support 16 with their edges spaced from each other define together with the substrate support 16 a cavity 32, the cross-section of which is triangular. The width of the slot-shaped gap 30 is so chosen relative to the volume of the cavity 32 that a low frequency cavity resonance is obtained immediately below the selected lower limit frequency, e.g. 200 Hz.

Although not especially apparent from the drawing each sound absorbent 20 is enclosed in a stretch bag or sock which can be made of nylon fabric. By this arrangement the mineral wool fibers are prevented from coming loose from the sound absorbents 20 when these are exposed to blows and stresses of different kind. Thus, the stretch sock holds the fibers together and at the same time it is an outer casing which is easy to wipe off and clean. In addition this outer casing can be dyed as desired, so that the echo-free room 10 can be made aesthetically attractive.

On the drawing some doors are also shown, one 34, through which measuring objects are transported in and out, and one 36 leading to an outer observation room. The latter is also provided with a window 38 through which the measuring object 12 can be inspected. Sound absorbing devices are placed as close to doors and windows as possible and, moreover, directly against the inside of the relative doors.

Modifications of the construction described above can of course be made within the scope of the invention. Instead of arranging a gap 30 between the sound absorbent 20, as shown in FIG. 2A, a corresponding gap 30' can be arranged between the sound absorbent 20' and the substrate support 16', as shown in FIG. 2B.

It is also possible to arrange blowing of uniformly distributed air into the room from said cavities 32, 32', via the corresponding gaps 30 and 30', respectively.

I claim:

1. A device intended for absorption of sound waves and for use as internal facing, primarily in so-called echo-free rooms, said device comprising a substrate support which consists of mineral wool plates, to which plate-shaped sound absorbents, preferably of mineral wool, are inclined relative to each other in such a way that they have a wave-like cross-section, wherein the angle between two sound absorbents placed with their edges close to each other on the substrate support is so chosen that the sound waves deriving from a measuring object are always reflected at least twice before they leave the device, and wherein the substrate support as well as two adjacent sound absorbents, which are placed on the substrate support with their edges in spaced relationship from each other, define a cavity with a gap between the sound absorbents and/or between sound absorbents and substrate support, which gap is so adapted that cavity resonance is obtained at a predetermined lower range of frequencies.

2. The device of claim 1, characterized in that the width of the sound absorbent is chosen in dependence of desired lower limit frequency of the operating range of the sound absorbent.

3. The device of claim 1, characterized in that each sound absorbent is enclosed in a stretch bag or sock of nylon fabric or the like.

4. A sound-absorbing internal facing for an echo-free room comprising a sheet-like substrate of sound-absorbing material, the substrate having a surface adapted to face inwardly when the substrate is attached to a wall ceiling or floor of a room, and plate-shaped elements of sound-absorbing material arranged on said surface of the substrate and inclined relative to each other and to said surface so as to have a wave-like cross-section, the angle between adjacent plates which diverge from each other in a direction away from the substrate being such that sound waves from a measuring object spaced from said surface are reflected at least twice before they leave said plates, and adjacent plates which converge toward each other in a direction away from the substrate forming a cavity bounded by said converging plates and the substrate, the edges of said converging plates remote from said substrate being spaced apart so as to form a gap between them such that cavity resonance is obtained at a predetermined lower range of frequencies.

5. A sound-absorbing internal facing for an echo-free room comprising a sheet-like substrate of sound-absorbing material, the substrate having a surface adapted to face inwardly when the substrate is attached to a wall ceiling or floor of a room, and plate-shaped elements of sound-absorbing material arranged on said surface of the substrate and inclined relative to each other and to said surface so as to have a wave-like cross-section, the angle between adjacent plates which diverge from each other in a direction away from the substrate being such that sound waves from a measuring object spaced from said surface are reflected at least twice before they leave said plates, and adjacent plates which converge toward each other in a direction away from the substrate forming a cavity bounded by said converging plates and the substrate, the edges of at least one of said converging plates adjacent said substrate being spaced from said substrate so as to form a gap between said edge and said substrate such that cavity resonance is obtained at a predetermined lower range of frequencies.

* * * * *